US006257546B1

(12) United States Patent
Deakin et al.

(10) Patent No.: US 6,257,546 B1
(45) Date of Patent: Jul. 10, 2001

(54) SLIP CASTING

(75) Inventors: Robert Norman Deakin, Stoke-on-Trent; Andrew Watson, Lichfield, both of (GB)

(73) Assignee: British Ceramic Research Limited, Staffordshire (DE)

( * ) Notice: Subject to any disclaimer, the term of this patent is extended or adjusted under 35 U.S.C. 154(b) by 0 days.

(21) Appl. No.: 09/155,433

(22) PCT Filed: Mar. 24, 1997

(86) PCT No.: PCT/GB97/00804

§ 371 Date: Jul. 21, 1999

§ 102(e) Date: Jul. 21, 1999

(87) PCT Pub. No.: WO97/35698

PCT Pub. Date: Oct. 2, 1997

(30) Foreign Application Priority Data

Mar. 27, 1996 (GB) ..... 9606447

(51) Int. Cl.[7] ..... B28B 1/26

(52) U.S. Cl. ..... 249/80; 249/81; 249/134; 264/86; 264/87; 264/84; 264/85

(58) Field of Search ..... 264/86, 87; 425/84, 425/85; 249/80, 79, 134

(56) References Cited

U.S. PATENT DOCUMENTS

| | | | | |
|---|---|---|---|---|
| 1,336,180 | | 4/1920 | Allen et al. . | |
| 2,984,887 | * | 5/1961 | Thiess | 264/86 |
| 3,156,751 | | 11/1964 | Valdes . | |
| 3,228,649 | * | 1/1966 | Delmotte | 264/86 |
| 3,754,852 | * | 8/1973 | Rempel | 425/429 |
| 3,929,685 | | 12/1975 | Jung . | |
| 4,413,966 | * | 11/1983 | Mills et al. | 425/84 |
| 4,664,610 | * | 5/1987 | Aoyama et al. | 425/84 |
| 4,727,092 | | 2/1988 | Will . | |
| 4,884,959 | * | 12/1989 | Ito et al. | 425/84 |

FOREIGN PATENT DOCUMENTS

| | | |
|---|---|---|
| 14 59 307 | 3/1969 | (DE) . |
| 36 35 455 A1 | 4/1988 | (DE) . |
| 0 194 757 A2 | 9/1986 | (EP) . |
| 0 516 224 | 12/1992 | (EP) . |
| 110 649 | 11/1917 | (GB) . |
| 792844 | 4/1958 | (GB) . |
| 1 284 890 | 8/1972 | (GB) . |
| 2 124 540 | 2/1984 | (GB) . |
| WO 83/02251 | 7/1983 | (WO) . |

OTHER PUBLICATIONS

Patent Abstracts of Japan, vol. 015, No. 267 (M–1133), Jul. 8, 1991 & JP 03 090302 A (Tokai Rubber Ind Ltd.), Apr. 16, 1991.

Patent Abstracts of Japan, vol. 014, No. 144; (M–0951), Mar. 19, 1990 & JP 02 009604 A (Katsunobu Ito), Jan. 12, 1990.

* cited by examiner

*Primary Examiner*—James Derrington
(74) *Attorney, Agent, or Firm*—Adams, Schwartz & Evans, P.A.

(57) ABSTRACT

A method of slip casting wherein reduced pressure is applied to the mold during casting by virtue of a network of piping extending through the mold. The mold has an impermeable outer coating. Heat may also be applied to the mold during casting, by for example a heated fluid passing through piping located in the walls of the mold.

17 Claims, 3 Drawing Sheets

SLIP CASTING

This application is a national stage application, according to Chapter II of the Patent Cooperation Treaty. This application claims the priority date of U.K. Patent Application No. 9606447.2 filed on Mar. 27, 1996.

This invention concerns improvements in or relating to slip casting, and particularly but not exclusively a method of slip casting, a mould usable in slip casting, and also a synthetic mould.

In slip casting, slip which comprises a suspension of clay and perhaps other materials in a fluid such as water, is supplied into a permeable mould such that the fluid in the slip is drawn into the mould leaving the suspended solid within the mould to build up a layer of cast solid material. Moulds can be of the open cast type where the layer of solid material is provided around the inner surface of the mould, or of the solid cast type where the solid material fills the interior of the mould. Conventionally the moulds have been made of plaster of paris which draws water thereinto by virtue of capillary forces between the needles of the material, and also by cation exchange. Considerable disadvantages can be encountered with plaster of paris moulds in that they only have a relatively short working life and can cause disposal problems. It is usual to have a "bank" comprising a plurality of moulds all connected to a single source of slip. Inconsistencies often occur between the moulds due to different chemical conditions in the moulds and/or different rates of wear thereby reducing product quality.

According to the present invention there is provided a method of slip casting, the method comprising supplying slip into a sealingly closed mould and applying reduced pressure to the mould so as to draw fluid from the slip into the mould to cause casting.

The mould is preferably connected to a supply of slip during casting. The reduced pressure is preferably applied to the mould prior to the supply of slip thereto.

The reduced pressure may be applied by sucking through the mould. The reduced pressure is preferably applied substantially uniformly throughout the walls of the mould. The reduced pressure may be applied by sucking fluid through a sealed pipe which extends around the mould and connects with a plurality of porous branch pipes spaced throughout the mould.

The mould is preferably heated during casting, and desirably to a temperature in the order of 40° C. The mould may be heated by passing a heated fluid through piping in the walls of the mould.

A plurality of moulds are preferably provided, and the maoulds may be connected to a single supply of slip, heated fluid and/or a single means for sucking fluid, which means may comprise a vacuum pump.

The mould preferably comprises a plurality of parts which are sealingly connectable together prior to casting.

After casting the cast piece is preferably held on a one or more of the mould parts by sucking fluid through only said one or more parts, and desirably also blowing fluid through some or all of the other parts to remove the cast piece therefrom. Following removal from said one or more other parts the cast piece may be located on a former and fluid blown through the said one or more parts to remove the cast piece therefrom.

The mould may be drained of slip prior to removal of the cast piece from the mould.

Following removal of the cast piece from the mould, fluid and desirably air is preferably blown through the mould to purge same.

The slip is preferably supplied into a plastics material mould.

The invention also provides a mould usable in slip casting, the mould comprising a plurality of parts sealingly connectable together to provide a closed permeable mould which is impervious to fluids outside of the mould.

An impermeable coating may be provided on the outside of the mould, and the coating may be formed of wax.

The mould may comprise means for supply reduced pressure within the walls of said mould, and said means may comprise a network of tubing extending within the walls and connectable to a source of reduced pressure.

The network of tubing may comprise a sealed tube extending around the mould with a plurality of porous tubes extending from the sealed tube. The porous tubes may extend between spaced locations on the sealed tube.

The mould preferably comprises heating means, and the heating means preferably extend substantially throughout the walls of the mould.

The heating means may comprise a pipe connectable to a source of heated fluid.

Alternatively, the heating means may comprise a heating element.

The mould preferably comprises an inlet connectable to a supply of slip.

The mould may be made of a plastics material and desirably a water fillable polyester.

The plastics material preferably has the following constitutents, and desirably in the following proportions:

| | Weight (%) |
|---|---|
| Acrylic resin | 0–10 |
| Polyester resin | 0–40 |
| Water containing surfactant | 0.1–4 |
| Initiator/Catalyst | 1–2 |
| Water | 4–40 |
| Acrylic Powder | 30–60 |

The acrylic resin preferably comprises a mix of polymethylmethacrylate in methylmethacrylate monomer. The polyester resin preferably comprises isophalic unsaturated polyester resin. The initiator/catalyst preferably comprises dibenzoyl peroxide. The acrylic powder preferably comprises methacrylate polymer.

The mould is preferably made by mixing the acrylic resin and powder with the polyester resin, subsequently adding the water containing surfactant to form an emulsion, adding the initiator/catalyst and pouring the mixture into a case mould.

Any heating means and/or network of tubing are preferably located in the case mould before the mixture is poured thereinto.

The mould is preferably purged with compressed air prior to use.

The pore size of the mould material is preferably 2–15 microns, and desirably 2–5 microns.

The invention still further provides a synthetic mould according to any of the previous six paragraphs.

The mould may be used in plastic forming of clay or other processes.

Embodiments of the present invention will now be described by way of example only with reference to the accompanying drawings, in which.

Figure 1:
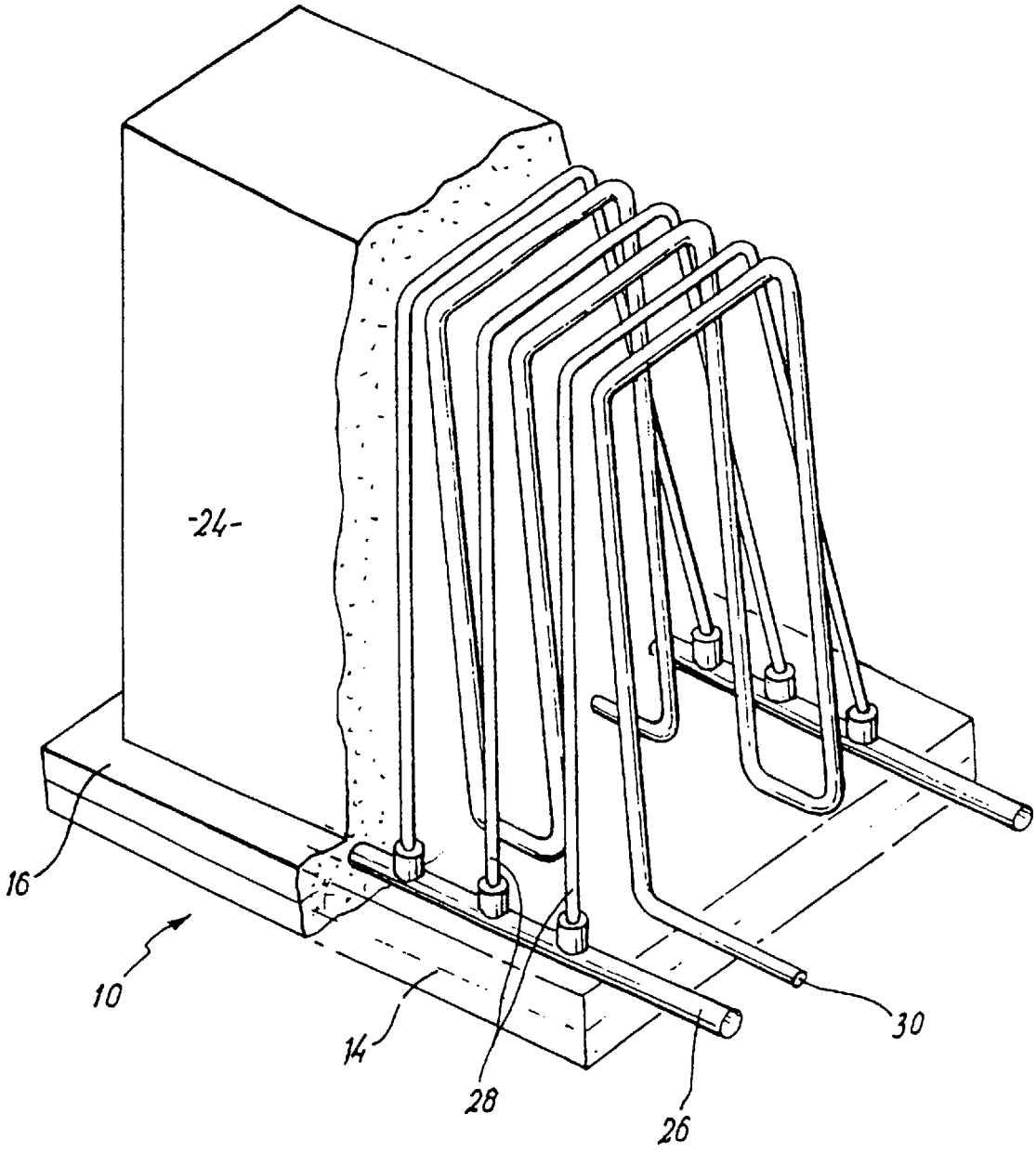
FIG. 1 is a diagrammatic partially cut-away perspective view of a first mould according to the invention.
Figure 2:
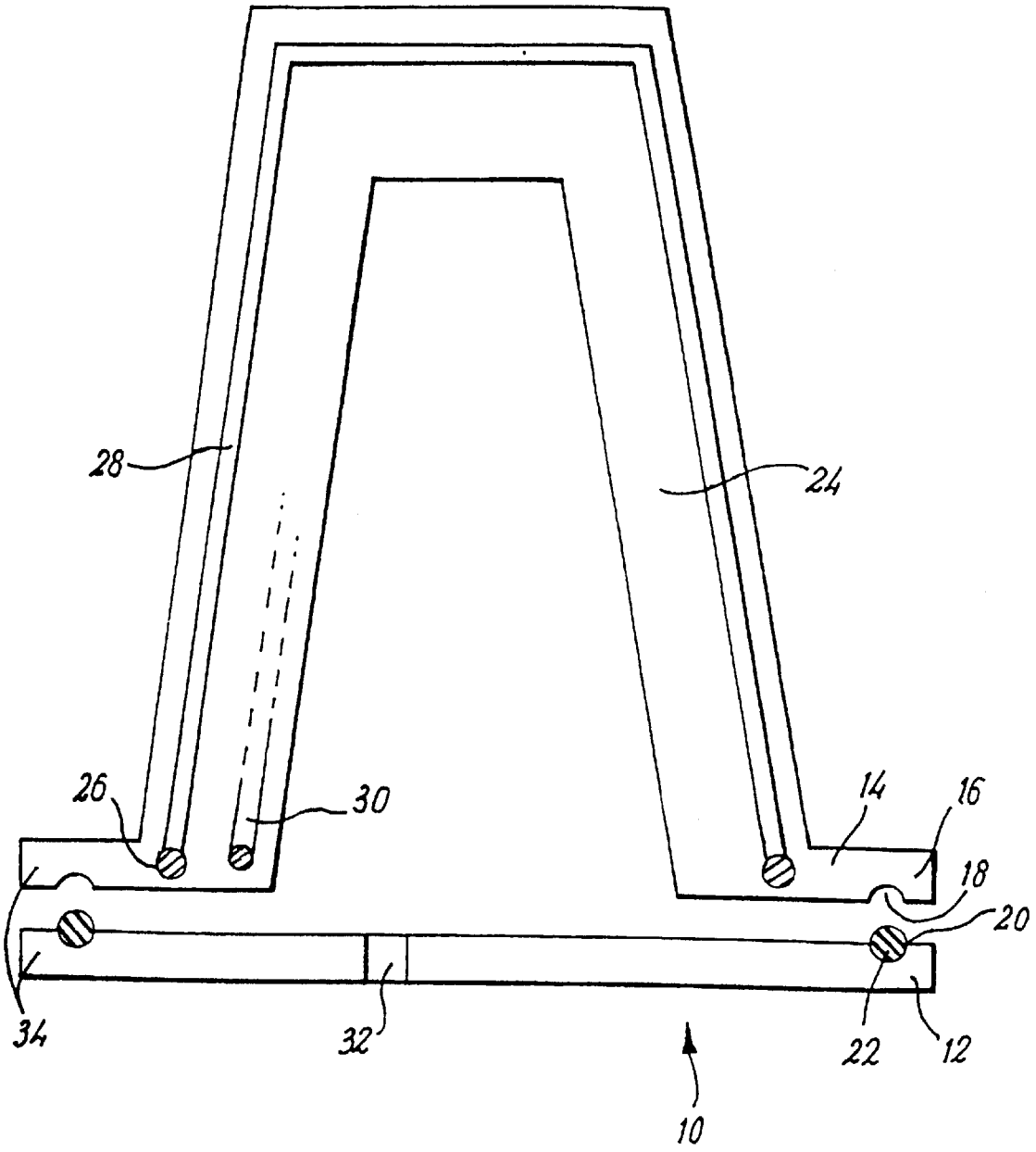
FIG. 2 is a diagrammatic cross-sectional view of the mould of FIG. 1.

FIGS. 1 and 2 of the drawings show a two-part open cast mould 10 comprising a first part 12 in the form of a flat lid and a second part 14 of uniform cross-section converging away from the lid 12. A flange 16 is provided on the part 14 with a recess 18 around the underside thereof. The part 12 is of a similar size to the underside of the part 14 and has a correspondingly positioned recess 20. A seal 22 in the form of an O-ring is locatable in the recesses 18 and 22 to seal the parts 12,14 together.

Located within the converging walls 24 of the second part 14 is a network of tubing. The network comprises a pair of feeder tubes 26 extending close to the connection between the walls 24 and the flange 16. The tubes 26 are formed of an impermeable material. A plurality of porous tubes 28 extend in a spaced relationship between the feeder tubes 26, in a parallel arrangement to the cross-section of the part 14. The feeder tubes 26 are connectable to a source of reduced pressure such as a vacuum pump.

A heating pipe 30 separate from the network tubing as depicted in FIG. 2 is also provided in the walls 24. The pipe 30 extends the length of the part 14 through a plurality of substantially 90° bends to extend from side to side of the part 14 as it extends along the length thereof. The pipe 30 is connectable to a supply of heated water. An inlet 32 is provided through the part 12 and is connectable to a supply of slip. The mould 10 is formed of a permeable material which will be described in further detail hereinafter. An impermeable coating 34 is provided on the external surfaces of the mould 10 such that when the parts 12,14 are connected the interior of the mould 10 is sealed from the outside save for the length 30.

In use for slip casting a clay item, a plurality of such moulds 10 would generally be arranged in a bank, with the respective feeder tubes 26 connected to a single source of reduced pressure, and the respective pipes 30 connected to a single source of heated water. Initially the inlet 32 is closed. Heated water at a temperature of around 40° C. is supplied into the pipe 30. Reduced pressure is also connected to the feeder tubes 26. The inlet 30 is then opened and slip pours into the mould 10 due to the reduced pressure therein. Water is taken up into the walls 24 of the mould 10 by virtue of the pore size thereof and also by virtue of the reduced pressure applied through the feeder tubes 26 and porous tubes 28. A layer of clay will thus form on the sides of the walls 24. The heat supplied by the water passing through the pipes 30 reduces the water viscosity thereby increasing the rate of casting and also provides strength to the cast piece. Any water from the slip taken up through the tubes 26 and 28 is removed via a water trap (not shown).

Once casting is complete slip is drained from the mould 10 and the two parts 12,14 separated. Reduced pressure may still be applied through the tubes 26,28 to hold the cast piece on the part 14. A shaped setter is then located adjacent the cast piece which may be blown off the part 14 by blowing air through the tubes 16,18 rather than sucking. Following removal of the cast piece the mould 10 can be purged of liquid by further blowing, probably at a greater pressure, through the tubes 26 and 28 such that the mould 10 returns to its original condition.

There is thus described a method of slip casting which provides considerable advantages relative to conventional arrangements. For instance, this method allows the mould to be returned to its original condition between each casting operation. Using reduced pressure rather than pressure casting alleviates the need for a slip pump. Such pumps can be subject to considerable wear and can also introduce air into the slip thereby causing imperfections in the cast clay. The impermeable feeder tubes for the reduced pressure ensure that the reduced pressure is substantially constant throughout the mould. The reduced pressure for each mould is connectable to the same source to ensure uniform conditions in different moulds. Warming the mould reduces water viscosity thereby increasing the rate of casting. The heat also provides strength to the cast piece. Providing the pipe extending through the mould means that all moulds can be heated to the same temperature and this alleviates any requirement for heating the slip.

It is to be realised that in many situations a more complex mould with a larger number of pieces would be required. Using the present method removes the need for clamping the mould pieces together as is particularly required in pressure casting. Where a plurality of mould parts are used, following casting it may be appropriate to hold the cast piece on one or more parts of the mould by applying reduced pressure thereto whilst gently blowing through the other parts. Once the cast piece is held on said one or more parts a shaped setter can be located adjacent the cast piece which can then be blown gently off said part or parts of the mould.

Various other modifications may be made without departing from the scope of the invention. For example a different method may be used to provide reduced pressure in the moulds. A different heating means may be provided. For instance, it has been found advantageous for the heating pipe 30 to be made of corrugated tubing to provide an increased outer surface area and thus improved heat transfer. The heating could be provided other than by a heated fluid. For example, a heating element could be provided extending through the mould.

The mould 10 is made of synthetic resin by the following method. An acrylic resin, acrylic powder and polyester resin are mixed together. A water containing surfactant (emulsifier) is then added to produce an emulsion. An initiator/catalyst is then added and the mixture is poured into a case mould already including the tubing and heating pipe etc. The case mould is subsequently demoulded, usually with the use of a release agent, and the newly formed mould is purged with compressed air prior to use. The particular materials in the mould are provided in the following compositions to provide a pore size of preferably 2–5 microns. Possible ranges for each of the mould materials are indicated in brackets.

| | Weight (%) |
|---|---|
| Acrylic resin - Polymethylmethacrylate/ methylmethacrylate monomer mix | 10 (0–10) |
| Polyester resin - Isophalic unsaturated polyester resin | 20 (0–40) |
| Water containing surfactant | 2 (0.1–4) |
| Initiator/Catalyst - dibenzoyl peroxide | 1 (1–2) |
| Water | 37 (4–40) |
| Acrylic Powder - methacrylate polymer | 30 (30–60) |

The water containing surfactant permits the small pore size to be obtained thereby providing natural capillary action on waters in the slip. The use of synthetic moulds provides for a very long mould life with consistent performance. The use of the small pore size along with the heating of the mould provides for a suitably high rate of casting to be economically viable. The impermeable coating on the mould is in the form of a wax but other materials could be used. Whilst the invention is described in relation to a synthetic resin mould the invention would be usable with a plaster of paris mould provided with an impermeable coating.

Figure 3:
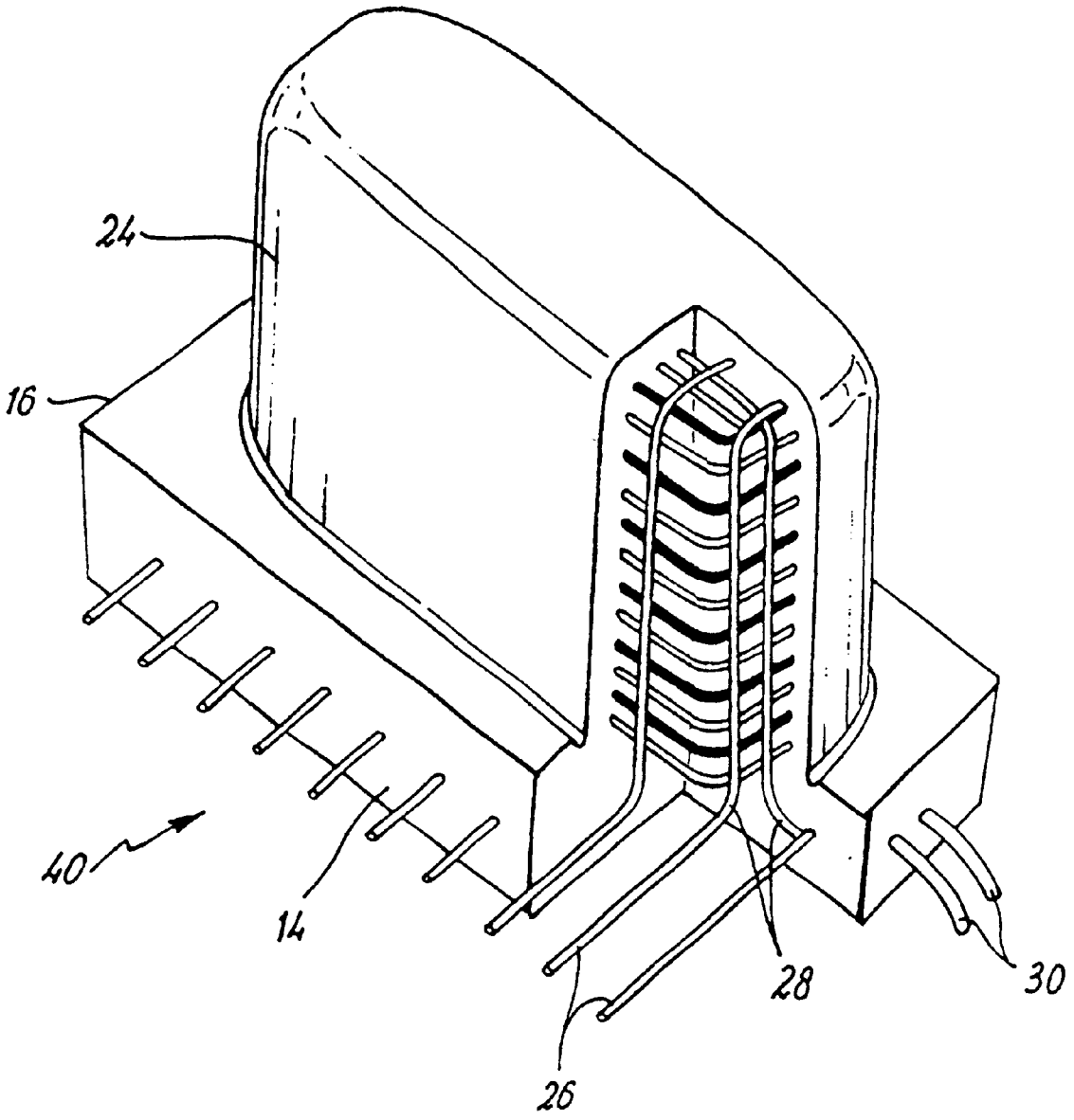
FIG. 3 is a similar view to FIG. 1 of a second mould according to the invention.

FIG. 3 shows a further mould 40 which is similar to the mould 10 except as outlined below. Similar reference numbers are used for similar components. In this instance the porous tubes 28 extend within the walls 24 in a grid-like arrangement with the heating pipes 30 extending within the grid. The tubes 28 connect with feeder rubes 26. The feeder tubes 26 are interconnected by an external manifold (not shown), which manifold would be re-usable in other moulds if required.

Moulds made from the above described method and materials could be used other than for slip casting, and could be used for example in processes such as plastic forming of clays.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A mold usable in reduced pressure slip casting, wherein the mold is made of plastics material and comprises a plurality of parts sealingly connectable together to provide a closed permeable mold with an impermeable coating provided on the outside of the mold, said mold comprising a heating pipe extending substantially throughout the walls of the mold, wherein the heating pipe is connected to a source of heated fluid, said mold also comprising means for supplying reduced pressure within the walls of said mold, said reduced pressure supply means comprising a network of tubing separate from the heating pipe extending within the walls and connectable to a source of reduced pressure.

2. A mold according to claim 1, wherein the impermeable coating is formed of wax.

3. A mold according to claim 1, wherein the network of tubing of said reduced pressure supply means comprises a sealed tube extending around the mold with a plurality of porous tubes extending from the sealed tube.

4. A mold according to claim 3, wherein the porous tubes extend between spaced locations on the sealed tube.

5. A mold according to claim 1, wherein the heating pipe includes a plurality of pipes.

6. A mold according to claim 1, wherein the mold comprises an inlet connectable to a supply of slip.

7. A mold according to claim 1, wherein the mold is made of a water fillable polyester.

8. A mold according to claim 7, wherein the plastics material has the following constituents in the following proportions:

| | Weight (%) |
|---|---|
| Acrylic resin | 0–10 |
| Polyester resin | 0–40 |
| Water containing surfactant | 0.1–4 |
| Initiator/Catalyst | 1–2 |
| Water | 4–40 |
| Acrylic Powder | 30–60 |

9. A mold according to claim 8, wherein the acrylic resin comprises a mix of polymethylmethacrylate and methylmethacrylate monomer.

10. A mold according to claim 8, wherein the polyester resin comprises isophalic unsaturated polyester resin.

11. A mold according to claim 8, wherein the initiator/catalyst comprises dibenzoyl peroxide.

12. A mold according to claim 8, wherein the acrylic powder comprises methacrylate polymer.

13. A mold according to claim 8, wherein the mold is made by mixing the acrylic resin and powder with the polyester resin, subsequently adding the water containing surfactant to form an emulsion, adding the initiator/catalyst and pouring the mixture into a case mold.

14. A mold according to claim 13, wherein the heating pipe and/or network of tubing are located in the case mold before the mixture is poured thereinto.

15. A mold according to claim 1, wherein the mold is purged with compressed air prior to use.

16. A mold according to claim 1, wherein the pore size of the mold materials is 2–15 microns.

17. A mold according to claim 16, wherein the pore size of the mold material is 2–5 microns.

* * * * *